United States Patent [19]

Newell et al.

[11] Patent Number: 4,847,453

[45] Date of Patent: Jul. 11, 1989

[54] LIMIT SWITCH WITH ACTUATOR

[75] Inventors: Edwin R. Newell, Fletcher; Simon S. Smith, Jr., Fairview, both of N.C.

[73] Assignee: Square D Company, Palatine, Ill.

[21] Appl. No.: 116,427

[22] Filed: Nov. 3, 1987

[51] Int. Cl.[4] ..... H01H 3/16

[52] U.S. Cl. ..... 200/47

[58] Field of Search ..... 200/47

[56] References Cited

U.S. PATENT DOCUMENTS

| | | | |
|---|---|---|---|
| 3,275,764 | 9/1966 | Kiessling et al. | 200/47 |
| 3,317,687 | 5/1967 | Dehn | 200/47 |
| 3,370,138 | 2/1968 | Vinot | 200/47 |
| 3,539,738 | 11/1970 | Bowen et al. | 200/47 |
| 3,649,785 | 3/1972 | Dietrich | 200/47 |
| 3,721,782 | 3/1973 | Roumagnac | 200/47 |
| 3,882,290 | 5/1975 | Duncan | 200/47 |
| 4,381,437 | 4/1983 | Geremia | 200/153 LB |
| 4,406,933 | 9/1983 | Boozer | 200/47 |
| 4,510,355 | 4/1985 | Atsumi et al. | 200/47 |

FOREIGN PATENT DOCUMENTS

| | | | |
|---|---|---|---|
| 2448708 | 4/1976 | Fed. Rep. of Germany | 200/47 |
| 693450 | 10/1979 | U.S.S.R. | 200/47 |

*Primary Examiner*—Renee S. Luebke

*Attorney, Agent, or Firm*—Richard T. Guttman; A. Sidney Johnston

[57] ABSTRACT

A limit switch includes a housing which encloses a snap switch having first and second pairs of spaced fixed contacts and first and second movable contacts supported on a carrier and operated by first and second reciprocating plungers that are biased to a first position. Toggle springs are interposed between the respective plungers and the carrier to move the carrier and the associated contacts between fixed pairs of fixed contacts during reciprocation of the respective plungers. An actuator head is mounted on the switch housing and has cams for actuating the respective plungers. In one preferred embodiment, the actuator head has a pair of concentric actuator elements that are respectively moved by first and second cams mounted on a shaft and configured so that rotation of the shaft in one direction will actuate one plunger, while rotation of the shaft in the opposite direction will operate the second plunger, thereby producing a neutral position for the limit switch in either direction of movement of the actuating shaft.

22 Claims, 6 Drawing Sheets

LIMIT SWITCH WITH ACTUATOR

DESCRIPTION

1. Technical Field

The present invention relates generally to a switch assembly and, more particularly, to a snap limit switch assembly of the type that has plural movable contacts interposed between respective pairs of fixed contacts with an actuator supported in a head mounted on the switch casing for moving the respective movable contacts between two positions.

2. Background Art

The use of limit switches in the machine tool environment has been known for many decades. Generally, the limit switches are designed to control the movement of a mechanical part. Limit switches are widely used in various fields of engineering, specially for automatic and semi-automatic control purposes. One important type of application of such an arrangement has to do with the reciprocation of a mechanical part, for instance a machine tool slide, which is to reverse in its direction of displacement at each end of its path of travel.

Normally, a limit switch assembly is provided at a stationary position along the path of reciprocation of the part for actuation by limit stops or cams projecting from the part. In other types of applications, one or more such switch assemblies may be associated in a similar manner with a moving part for actuation by stops or camming means projecting from the part at one or more points of its path of travel for synchronizing the motion of the part with various control functions in a complex automatic or semi-automatic electromechanical control system.

Usually, the switching mechanism consists of some type of limit switch incorporated into a switch housing and having an operating head connected thereto which moves the contacts of the limit switch in response to movement, generally rotation, of a shaft in the operating head. Examples of such devices are disclosed in U.S. Pat. Nos. 3,275,764 and 4,406,933, assigned to the Assignee of the present invention. Additional switching devices are of similar character are disclosed in U.S. Pat. Nos. 3,317,687; 3,370,138; 3,539,738; 3,721,782; and, 3,882,290.

Generally, limit switches of the type under present consideration consist of basically two sections, including a snap switch section and a lever head section, such as disclosed in U.S. Pat. No. 3,275,764. The lever head section or external operating mechanism generally has a shaft rotatable through an actuator arm and has cams that operate the snap switch upon being rotated in either direction. Generally, these devices are designed to translate the rotary movement of the shaft in the lever head to a linear movement of a member in the lever head for operation of the snap switch by a single plunger.

These types of switches usually have a single carrier with movable contacts at opposite ends thereof that are moved by the plunger. It has been found that the use of a solid carrier can produce an undesired "cross-trip" under certain conditions, i.e., both movable contacts will trip simultaneously, which must be avoided.

While the various types of limit switches in existence today have operated successfully, manufacturers of such products are constantly looking for improvements that will increase the versatility of the mechanisms, and at the same time can be manufactured at reduced costs.

SUMMARY OF THE INVENTION

According to the present invention, an improved limit switch has been developed which can easily be operated as a neutral position switch or a two-stage switch merely by a change in the actuator head.

More specifically, the limit switch of the present invention includes a switch housing that has first and second pairs of spaced fixed contacts therein and first and second movable contacts supported on a carrier and moved between the respective fixed contacts through first and second plungers that are reciprocated in the switch housing. First and second toggle spring means are located between the carrier and the respective plungers for producing a snap action of the movable contacts with respect to the fixed contacts upon movement of the plungers from a first position. In the preferred embodiment shown, the carrier for the two movable contacts is formed of two separate elements that are pivoted about a common axis in the housing and have the movable contacts respectively connected to the outer ends thereof.

In one preferred embodiment, the respective plungers are operated by a pair of levers that are pivoted at one end on the switch housing and cooperate with movable elements in the actuating head of the switch assembly. The actuating head of this embodiment consists of a housing having a shaft rotatable therein and an actuator arm extending therefrom with first and second cams on the rotating shaft. The respective cams cooperate with and linearly move two actuating elements that engage the lever arms in the switch housing to respectively operate the first and second plungers.

According to one aspect of the invention, the switch assembly of this embodiment is designed to be a neutral-position switch, and the actuator arm and shaft are biased towards a neutral position and can be moved in opposite directions from the neutral position. In movement in one direction, one of the cams actuates one of the plungers to trip a first set of contacts, while rotation in the opposite direction will cause the second cam to operate the second plunger and trip a second set of contacts.

In a further embodiment, the limit switch can be actuated sequentially through the use of a single cam on the actuating shaft and a single lever pivoted in the switch housing so that rotation of the cam in either direction will first actuate the first plunger and subsequently actuate the second plunger.

In several alternate embodiments, the actuating head has reciprocating or pivoting operating means to move the actuator.

DETAILED DESCRIPTION

Figure 1:
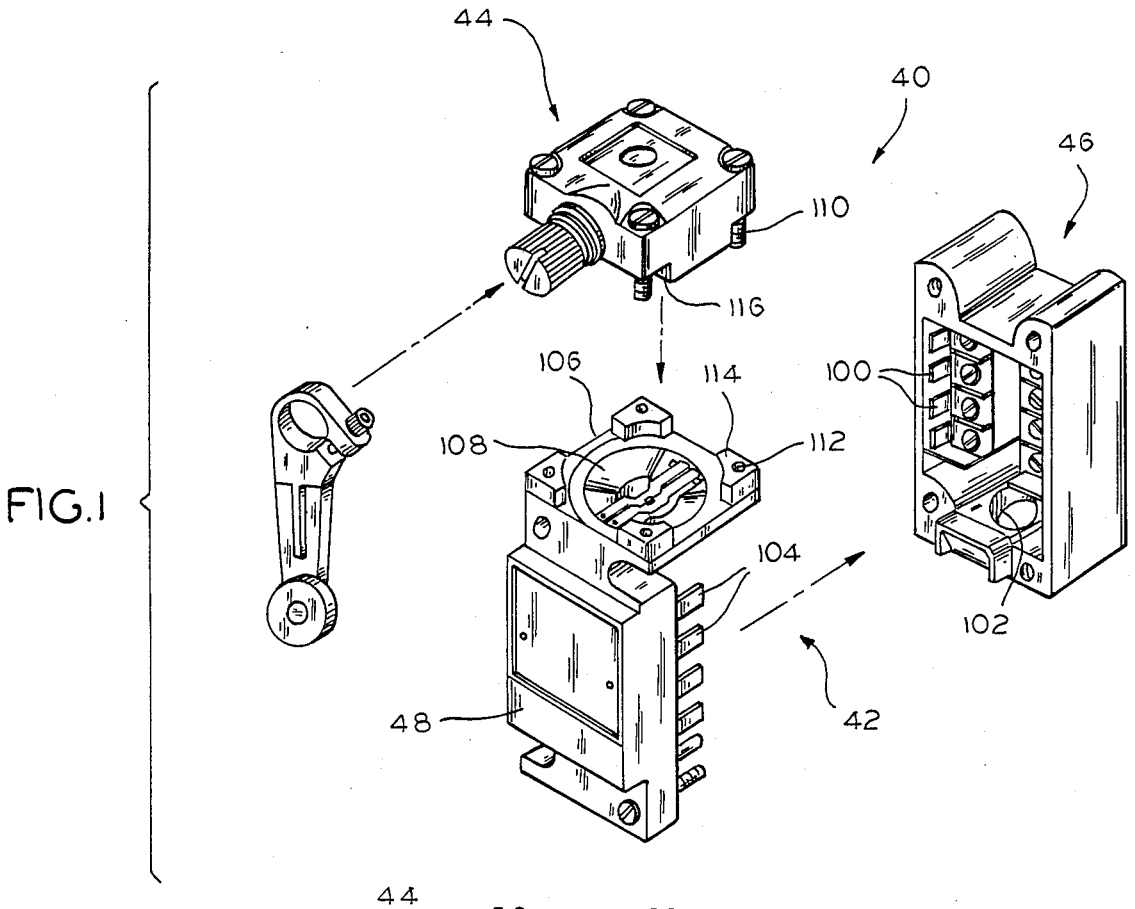
FIG. 1 is an exploded perspective view of the switch assembly constructed in accordance with the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to embodiments illustrated.

Referring to FIG. 1 of the drawings, an electrical switch assembly is generally designated by reference numeral 40 which includes a lower switch housing 42 and an upper operating head 44. The lower housing is formed of two mating parts 46 and 48 which enclose various electrical connections, which will be described later.

Figure 2:
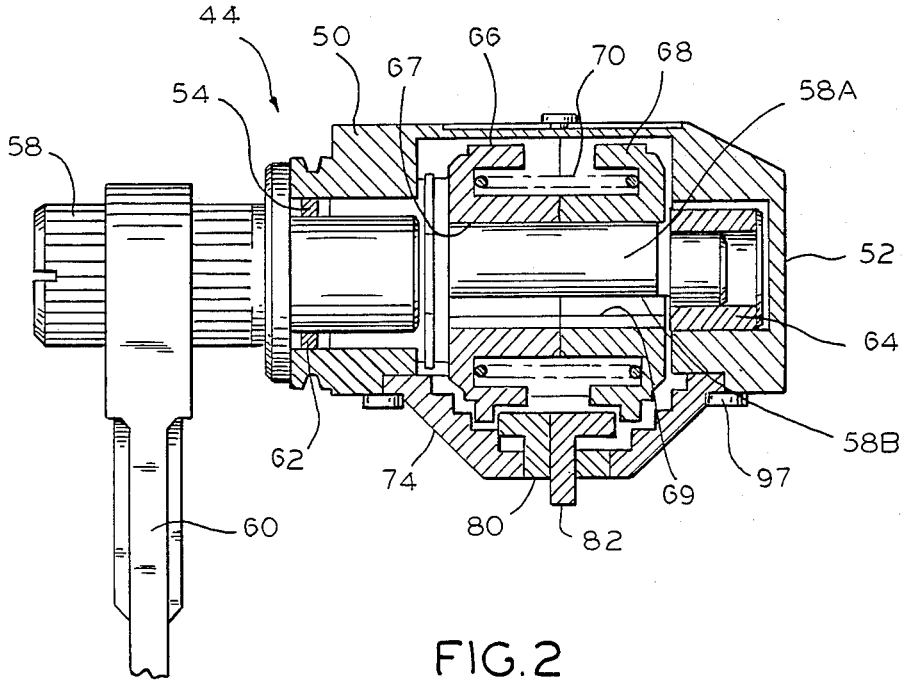
FIG. 2 is a cross-sectional view of the operating head of the switch assembly shown in FIG. 1.
Figure 4:
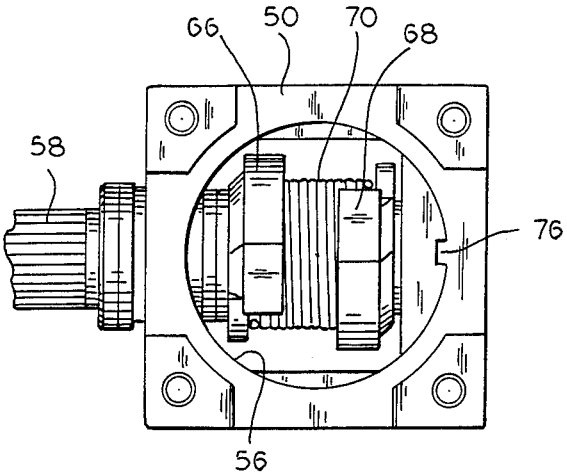
FIG. 4 is a bottom view of the operating head, as viewed along line 4—4 of FIG. 3.
Figure 3:
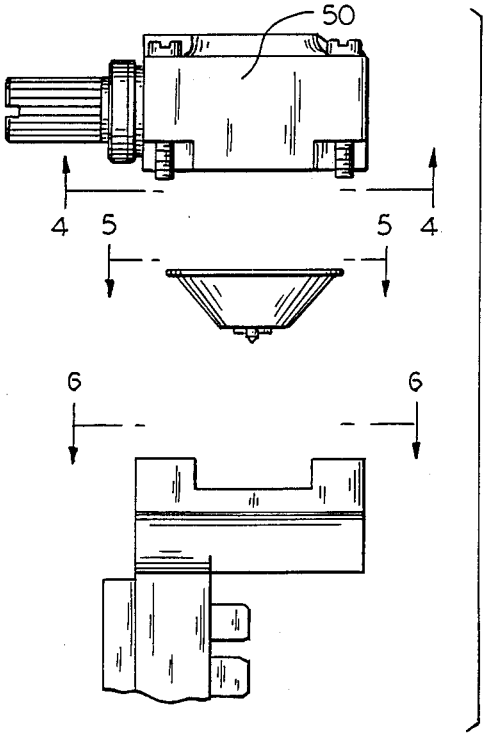
FIG. 3 is a partially-exploded view of the upper portion of the switch housing and the operating head.
Figure 12:
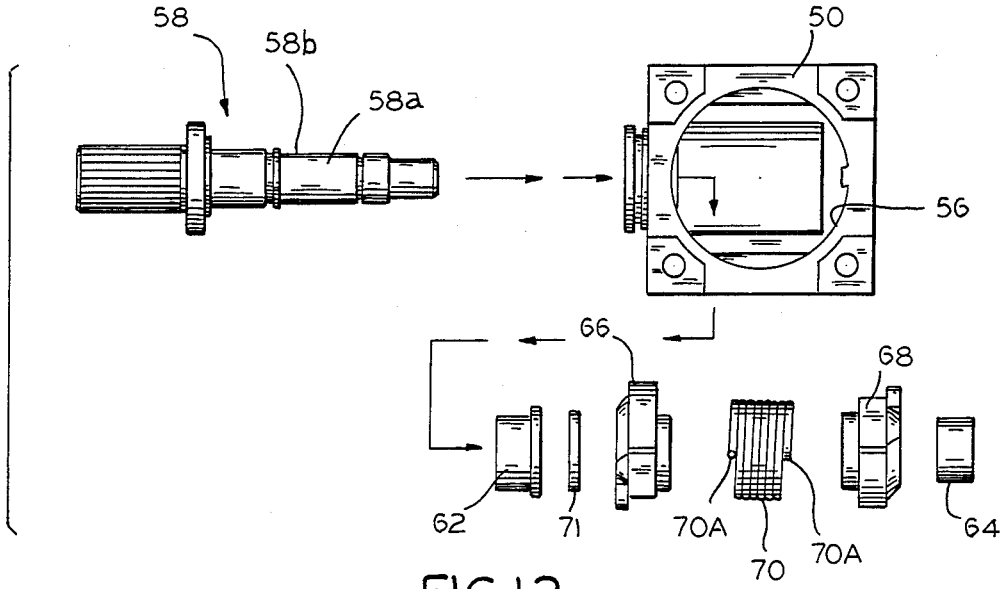
FIG. 12 is an exploded view of the operating head showing the manner of assembly of the various components thereof.

Consider first the operating head 44, which is shown in cross-section in FIG. 2 and includes a housing 50 that is closed at one end 52 and has an opening at the opposite end 54 and a bottom opening 56 (FIG. 4). An actuator shaft 58 having a lever 60 attached thereto extends into the opening 54 and is supported by brass bushings 62 and 64 (see FIG. 12). The shaft 58 has a central reduced diameter portion 58A, which has a flattened chordal portion 58B removed therefrom, and supports first and second cams 66 and 68 which have a shaft return torsion spring 70 therebetween (FIG. 2). The cams 66 and 68 have circular openings 67 with an inwardly-directed projection 69 extending from the surface defining each of the openings. One or more sealing rings 71 may be interposed between the various parts.

In assembly, the cams 66 and 68 are positioned such that the projections 69 are aligned with the flat chordal portion 58B when in the assembled condition. In the assembled condition, the opposite ends 70A of the torsion spring 70 engage abutments on the cams 66 and 68. As is well known in the art, the shaft return spring 70 and the first and second cams 66 and 68 are structured such that only the first cam 66 rotates when the shaft is turned in one direction, i.e., clockwise, and only the second cam 68 rotates when the shaft is turned counterclockwise. The flat chordal portion 58B is configured to allow one cam to rotate about 90° while the other cam remains stationary. The shaft return spring 70 causes the shaft 58 to return to an intermediate neutral position when no external force is applied to the shaft.

The shaft and cams are considered the operating means for the actuating means to be described below.

Figure 5:
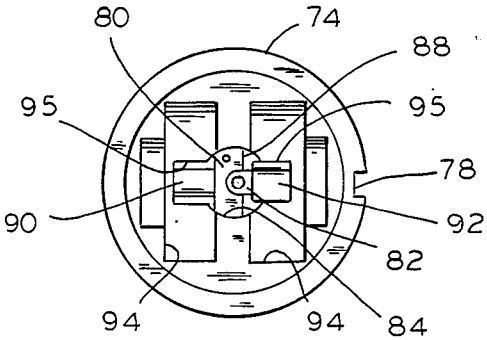
FIG. 5 is an inside plan view of the cover, as viewed along line 5—5 of FIG. 3.
Figure 7:
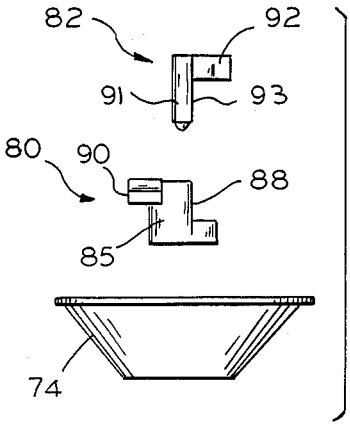
FIG. 7 is an exploded view of the components that form part of the lower portion of the actuating head.

As indicated above, the housing 50 has a lower circular opening 56 therein which exposes the cams 66 and 68 and is enclosed by a cover 74 (FIG. 5). As illustrated in FIGS. 4 and 5, the housing 50 has a projection 76, while the cover 74 has a notch 78 for alignment purposes. The cover 74 supports first member 80 which in turn supports the second actuating member 82 (FIG. 7).

Actuating member 80 is reciprocated within a circular opening 84 that is located in the bottom of the cover 74, while actuating member 82 is reciprocated in an opening 86 in actuating member 80.

The details of the actuating members or cam followers 80 and 82 are shown in FIGS. 7–11, as well as FIG. 5. The first actuating member 80 has a circular body 85 that has an opening 86 therein. The main body 84 has a flattened chordal portion removed to define a flat guide surface 88, for a purpose to be described later. The first actuator element 80 also has a rectangular offset camming element 90 that defines an inclined camming surface 90A (see FIG. 11) which engages with cam 66.

Figure 8:
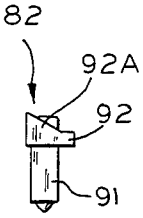
FIG. 8 is a side elevational view of one of the operating elements.
Figure 9:
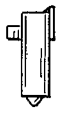
FIG. 9 is a view of the operating element shown in FIG. 8, showing the actuator element in a 90° rotated position.
Figure 10:
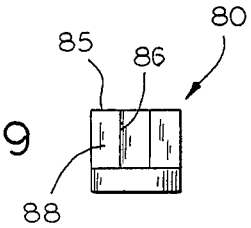
FIG. 10 is a side view of the second actuating element.
Figure 11:
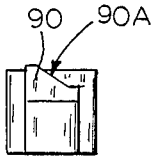
FIG. 11 is a view of the second operating element shown in FIG. 10, showing the actuating element in a second 90° rotated position.

The second actuator element or member 82 is illustrated in FIGS. 8 and 9 and includes a circular pin 91 that has a rectangular offset camming element 92 which has an upper inclined camming surface 92A.

The pin 91 has a chordal portion removed to define a flat guide surface 93. The first actuator element has a projection (not shown) which engages guide surface 93.

The actuator members are mounted in the cover 74 in such a manner as to limit the movement of the actuator member to reciprocal motion. Thus, as shown in FIG. 5, the inner surface of the cover 74 has first and second arcuate wells 94 that receive the respective cams 66 and 68 and the wells 94 have rectangular slots 95 at the bases thereof. The rectangular slots 95 respectively receive the rectangular camming elements 90 and 92. The rectangular slots will therefore limit the movement of the actuator members to reciprocable motion and the camming elements are positioned on opposite sides of the center of the cover. Also, the guide surfaces 88 and 93 will prevent rotation of the actuator elements.

Thus, with the components assembled in the condition shown in FIG. 5 and the cover mounted in the opening 56 (FIG. 2), clockwise rotation of the shaft 58 will rotate the cam 66 and reciprocate the first actuator element 80 within the opening 84, while counterclockwise rotation of the shaft 58 will rotate cam 68 to reciprocate actuator 82 through the cam surface 92A.

The assembled condition of the actuator head 44 and the components described above is shown in cross-section in FIG. 2 in proper position for mounting onto the limit switch housing 42. For this purpose, a sealing ring 97 may be interposed between the housing 50 and the switch housing 42, as will be explained later. As indicated above, the switch housing 42 is formed in two component sections 46 and 48 with housing section 46 having a plurality of contacts 100 mounted therein and a bottom threaded opening 102 which is adapted to receive an electrical conduit (not shown) through which electrical conductors are passed from the exterior of the housing 46 into the cavity formed in the housing 46.

The mating housing section 48 has cooperating terminals 104 that mate with terminals 100 in a manner well known in the art. The housing section 48 encloses the novel switch assembly, to be described later, which is actuated by the actuating elements 80 and 82. For this purpose, the housing 48 has an upper offset head portion 106 which has a well 108 defined therein that corresponds in configuration to the cover 74 so that the cover is accurately positioned within the head portion 106.

The operating head 44 is connected to the member 106 through a plurality of screws 110 that are received into threaded openings 112 defined on projections 114 located at the respective corners of the rectangular member 106. Projections 114 are configured to correspond to the recesses 116 located at the corners of the operating head 44. Thus, when assembled, the actuating members are properly aligned with the snap switch components, as will be described later.

Figure 19:
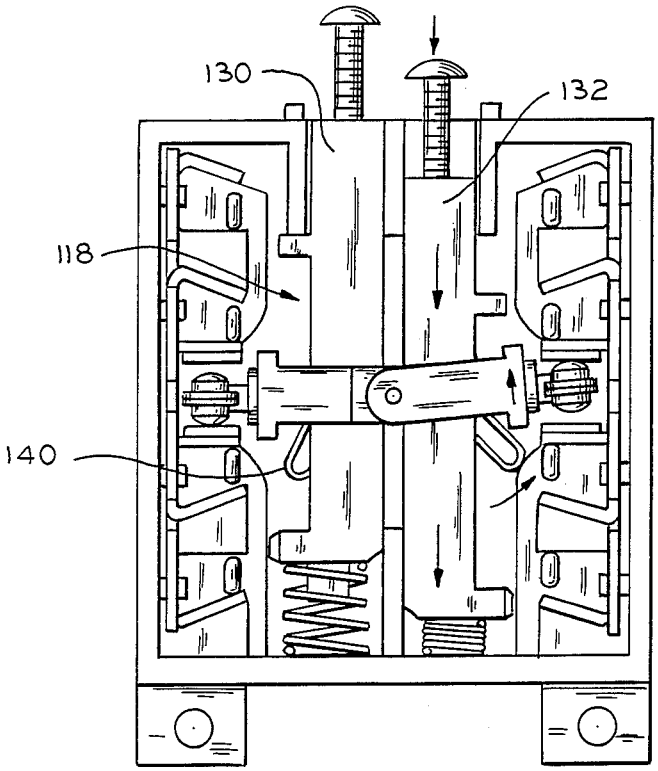
FIG. 19 is a view of the internal components of the limit switch assembly.
Figure 20:
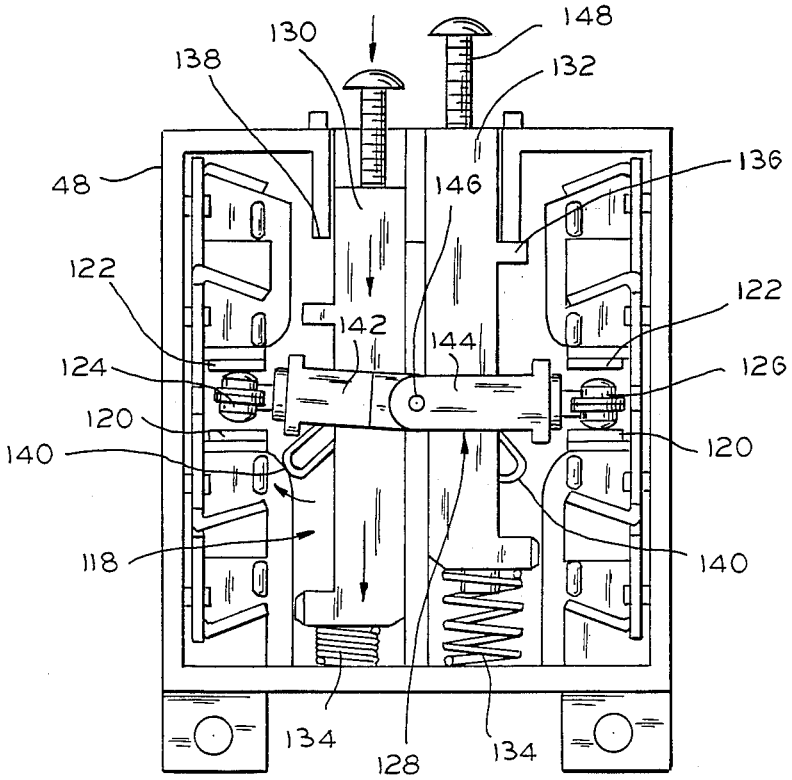
FIG. 20 is a view similar to FIG. 19.

The novel dual plunger snap switch 118 is shown in FIGS. 19 and 20, in which the housing 48 defines a cavity which houses the snap switch. The cavity has front and rear first pairs of fixed contacts 120 and second pairs of upper fixed contacts 122 that are operatively connected to the terminals 104 in a manner well known in the art only one of each being shown. First and second pairs of movable contacts 124 and 126 are respectively mounted on a carrier member 128.

The carrier member 128 is operated through first and second plungers 130 and 132 which are reciprocated within the cavity and are biased to n upper first position through coil springs 134. The first upper position is preferably defined by stops 136 integral with the plungers which engage with abutments 138 that are formed in the cavity of housing 48.

A pair of over-center toggle spring means 140 are interposed between the respective plungers and the carrier member 128. For this purpose, the toggle springs 140 have opposite ends which are respectively received into slots (not shown) formed in the carrier member and in the plunger.

According to one aspect of the invention, the carrier member is preferably formed into two separate parts, preferably interconnected intermediate the contacts 124 and 126. Thus, as shown in FIG. 20, the carrier member includes first and second carrier elements 142 and 144 which are pivoted on a fixed pivot pin 146 that is located between the respective plungers.

Figure 6:
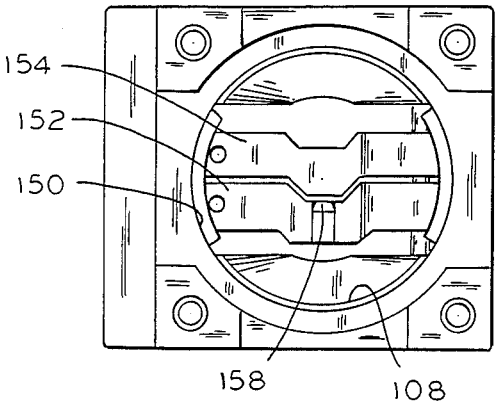
FIG. 6 is a plan view of the upper portion of the switch housing, as viewed along line 6—6 of FIG. 3.
Figure 17:
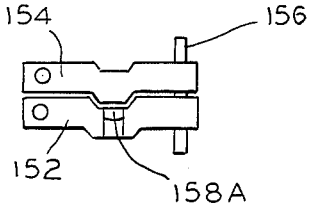
FIG. 17 shows the two levers in an assembled position on a support pin.
Figure 18:
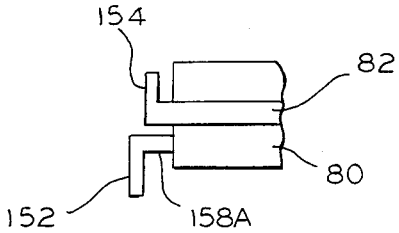
FIG. 18 is a view showing the actuating elements associated with the levers.

The respective plungers may have adjustable screws 148 on the upper ends thereof which are engaged by actuating levers, illustrated in FIGS. 13–17 and FIG. 6. As is apparent, since the plungers 130 and 132 are offset a substantial distance from the center of the well 108 and the actuating members 80 and 82 are concentric with the center of the well, as well as the center of the cover 74, provision must be made for translating the motion to the plungers. Thus, as shown in FIG. 6, the well 108 has a central opening 150 therein into which has first and second levers 152 and 154 pivoted therein. The respective levers are pivoted at one end on the switch housing 48 through a pivot pin 156 (FIG. 17).

Figure 13:
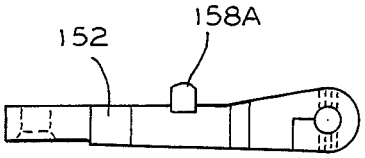
FIG. 13 is a side view of one of the operating levers in the switch housing.
Figure 15:
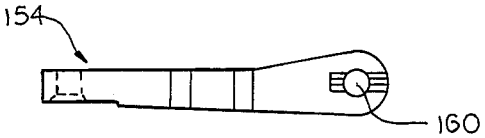
FIG. 15 is a side elevational view of a second lever.
Figure 14:
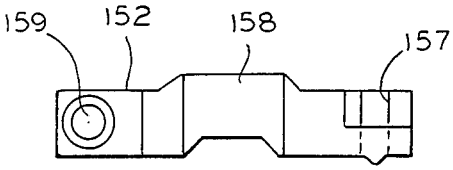
FIG. 14 is a bottom view of the lever shown in FIG. 13.
Figure 16:
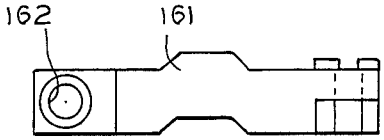
FIG. 16 is a bottom view of the lever shown in FIG. 15.

The actuating lever 152 is designed to cooperate with the actuator element 80 and is shown in detail in FIGS. 13 and 14. Thus, one end of the lever has an opening 157 for receiving the pin 156 and has an offset portion in the intermediate area while having a seat 159 at the opposite end. The intermediate portion 158 has an upwardly-directed projection 158A which is offset from the center of the well 108 in the assembled condition, as clearly shown in FIG. 6.

The second actuating lever 154 is shown in FIGS. 15 and 16 and again includes an opening 160 receiving the pin at one end thereof and offset portion 161 intermediate opposite ends and a seat means 162 at the opposite end. In the assembled condition shown in FIG. 6, the offset intermediate portion is thus aligned with the center of the well 108 and is therefore aligned with the center pin or actuator element 82.

It should be noted that the levers are configured so that the operating head can function at any of four orientations because the projection 158A contacts the collar- or ring-type actuator or cam follower 80.

Thus, when the operating head 44 is attached to the switch housing 42, the first actuator 80 will be aligned with the projection 158A on the lower surface thereof, while the second actuator 82 will be aligned with the lever 154 in the offset intermediate portion 161. The opposite ends or seats 159 and 162 will receive the heads of the adjustable screws 148 on the respective plungers 130 and 132 upon rotation of the shaft 58. Rotation of the actuating lever 60 in the clockwise direction will cause rotation of the shaft 58 and cam 66 about 90° to move the actuator 80 in the axial direction engaging and pivoting the lever 152 to depress the plunger 130.

Depression of the plunger 130 will cause the toggle spring 140 to move overcenter and thereby cause the contacts 124 to snap from the position shown in FIG. 19 to the position shown in FIG. 20. Likewise, counterclockwise rotation of the shaft 58 will rotate cam 68 producing axial movement of the center pin 82 in engagement with lever !54 thereby pivoting the lever and moving the second plunger 132 to the lower position and move the contacts 126 from the lower to the upper position. Thus, activation of either plunger will move one set of contacts while the other set remains in its initial or normal position.

Figure 21:
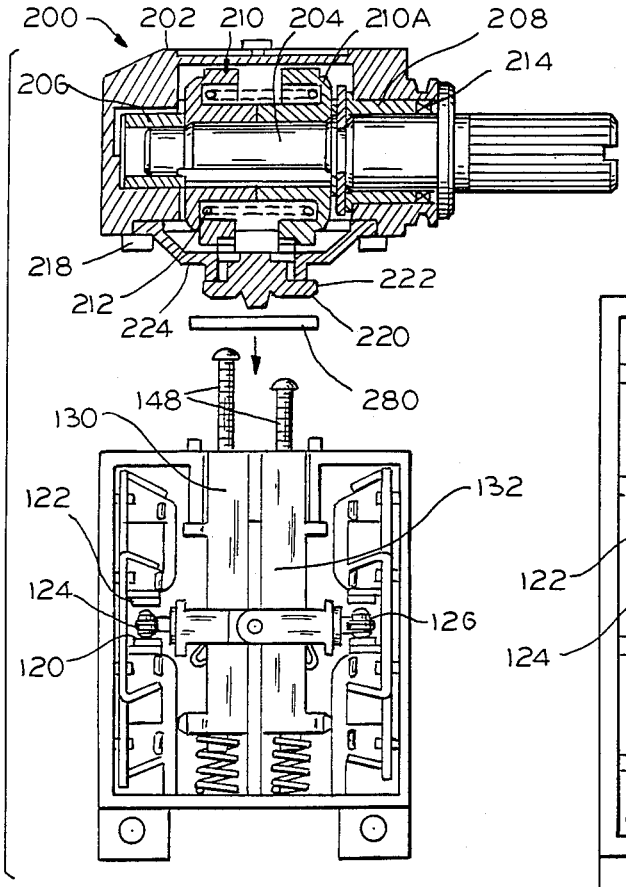
FIG. 21 is an exploded view showing a modified operating head used for two-stage operation of the limit switch.
Figure 22:
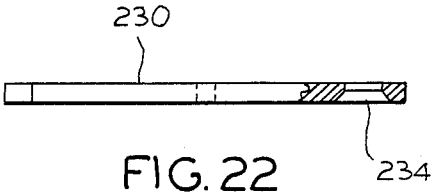
FIG. 22 is a side view of the operating lever for the embodiment shown in FIG. 21.
Figure 23:
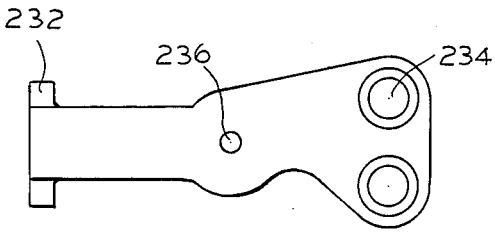
FIG. 23 is a plan view of the lever shown in FIG. 22.

FIGS. 21, 22 and 23 show a slightly modified form of operating head for sequentially operating the movable contacts of the limit switch 118, which is substantially identical to that described above. In this embodiment, the actuator head 200 includes a housing 202 that has a shaft 204 rotatable therein and supported by bushings 206 and 208. A cam 210 is supported on the shaft 204 and is biased to a neutral position by a torsion spring 212. The cam 210 is preferably formed with two identical spring cups 210A that enclose the spring 212 and have camming surfaces formed thereon. A sealing member 214 is interposed between the housing 202 and the shaft 214 to enclose the components within the housing.

The housing 202 has a lower circular opening 218 which has an actuator member or cam follower 220 reciprocated in a center opening 222 of a cover 224. Thus, rotation of the shaft in either direction from the neutral position will rotate the cam 210 and reciprocate the actuator element downwardly, as shown by the arrow in FIG. 21. The downward motion of the actuator element 220 is translated to the plungers130 and 132 of limit switch 118 through an actuating lever 226.

The actuating lever is shown in detail in FIGS. 22 and 23 and consists of a main body 230 that has a pair of projections 232 at one end which define a pivot axis for the lever within the housing of the limit switch. The opposite end of the lever has a pair of seats 234 defined therein which are transversely spaced by a dimension equal to the transverse spacing of the screws 148 on plungers 130 and 132. The lever 226 also has an opening 236 aligned with the center of the actuator element 220 to receive the reduced diameter button on the lower end of the actuator element 220.

Thus, rotation of the actuator shaft 204 in either direction will reciprocate the actuator element 220 downwardly to pivot lever 226 and sequentially engage the plungers 130 and 132. The pivoting lever 226 will initially contact screw 148 on plunger 130 to trip the first set of movable contacts 124 into engagement with the upper fixed contacts 122 and subsequently engage the screw 148 on plunger 132 o trip the second set of movable contacts 126 into engagement with the upper fixed contacts 122, which will result in a two-stage operation of the limit switch 118. The respective contact screws 148 can be adjusted to trip the respective contacts at any angular orientation of shaft 204. Of course, the sequence of operation could be reversed by adjustment of the screws 148.

Figure 24:
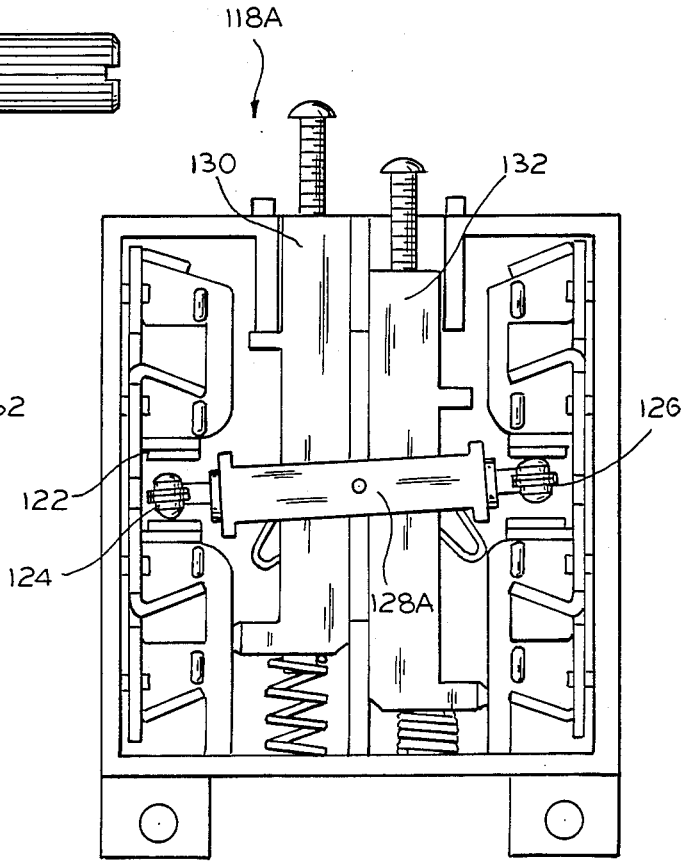
FIG. 24 is a view similar to FIG. 19 showing a slightly modified form of switch contact carrier means.
Figure 25:
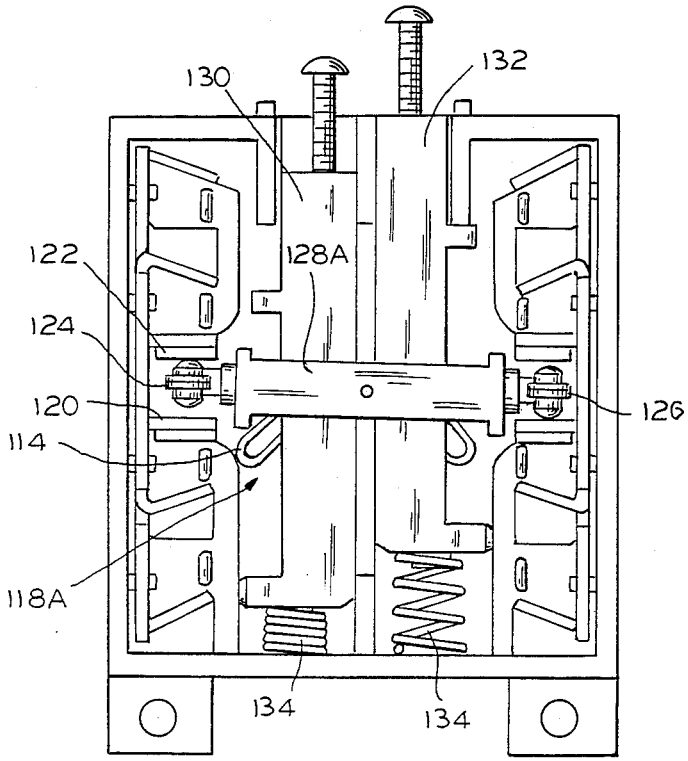
FIG. 25 is a further view showing the modified form of the invention in an operative position.

A slightly modified form of limit switch is shown in FIGS. 24 and 25 wherein the switch 118A is substantially similar to the switch components described above. In this embodiment, the carrier 128A is a single-piece unit which is normally biased into a position wherein the movable contacts 124 and 126 are biased into engagement with the lower fixed contacts 122 through toggle springs 140 when the plungers 130 and 132 are in the upper-most position. In this embodiment, as in the previous embodiment, the downward reciprocation of either plunger 130 or 132 will cause the toggle springs to move overcenter and move either movable contacts 124 or 126 into engagement with the upper fixed contacts 122.

Figure 26:
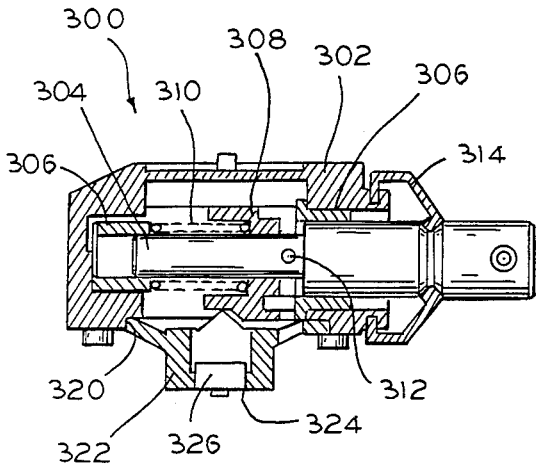
FIGS. 26–29 show different types of operating heads.

FIG. 26 discloses a slightly modified form of operating head 300 that includes a housing 302 having a plunger 304 supported by bearings 306. The plunger or shaft 304 has a cam 308 formed thereon, which defines operating means, and are is biased to the first position shown in the drawings through a spring 310. This first position may be defined by a cross-pin 312 carried by the shaft 304. A flexible sealing element 314 is preferably interposed between the housing 302 and the shaft 304.

The bottom of the housing has an opening 320 therein which receives a cover 322 that has a center opening 324 which supports an actuator or cam follower 326. The exposed end of the shaft 304 may have a follower element, such as a roller (not shown), adhered thereto to produce the reciprocal motion of the shaft. Thus, axial movement of the shaft in the left-hand direction, as viewed in FIG. 26, will cause the cam 308 to reciprocate the actuator 326 and thereby operate the switch.

Figure 27:
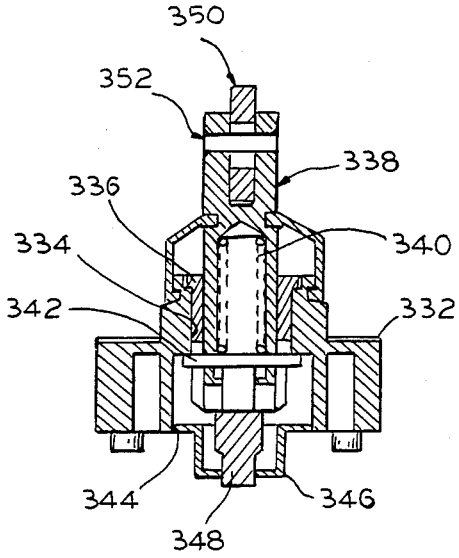

A further modified form of operating head is shown in FIG. 27 and includes a housing 332 that has a center axial opening 334 with a bearing 336 received into the opening. A plunger or operating means 338 is reciprocated within the bearing 336 and is biased into the upper position by a spring 340. For this purpose, the plunger or shaft 338 has a cross-member 342 that is reciprocated in an enlarged portion of the opening 334 and engages an abutment in the uppermost position. A lower end of the housing has an enlarged opening 344 which receives a cover 346 that has an actuator 348 reciprocated therein.

The upper end of the shaft 338 has a follower 350 supported by a pin 352. Thus, downward reciprocal motion of the shaft or plunger 338 will move the actuator 348 and operate the switch.

Figure 28:
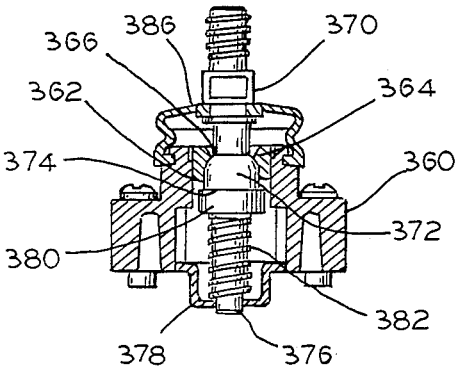

A further modified form of operating head is shown in FIG. 28 and includes a housing 360 that has an opening 362 extending therethrough. A bearing 364 is received into the upper end of the opening and has a inner spherical surface segment 366. A plunger or operating means 370 has an enlarged head 372 at the lower end thereof which has a peripheral surface that mates with the spherical surface 366 and has a flat lower surface 374. An actuator 376 extends through an opening in a lower cover 378 and has an enlarged head 380 at the upper end thereof which is biased into engagement with the flat surface 374 through a spring 382. A boot 386 is interposed between the upper end of the housing and the shaft or plunger 370 to seal the upper end of the opening in the housing.

This embodiment of operating head is specifically designed for universal movement of the upper end of the plunger or shaft about 360° of movement. Thus, if the upper end of the plunger is axially displaced, the enlarged head 372 will pivot within the spherical bearing surface and displace the actuator 376 in the downward position to actuate the switch.

Figure 29:
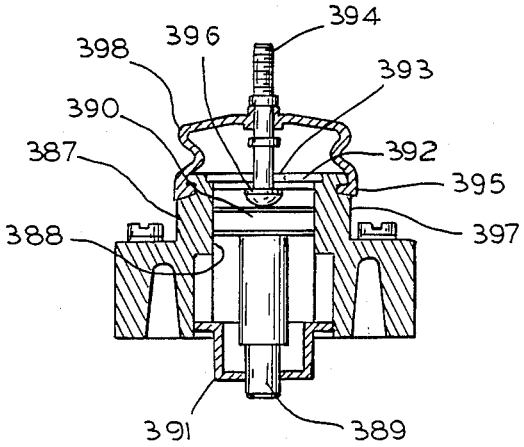

FIG. 29 shows a further modified form of operating head similar to the operating head shown in FIG. 28 which includes a housing 387 that has an axial opening 388 therein. An actuator 389 is reciprocated within the opening and has a narrow enlarged head 390 at the upper end thereof for producing limited contact between the inner surface of the opening 388 and the actuator 389. The lower end of the actuator extends through a cover 391 enclosing the lower end of the opening 388. A plate 392 encloses the upper end of the opening 388 and has a center opening 393 through which a plunger or shaft 394 extends. The lower end of the plunger has an enlarged head 395 that has a flat upper surface 396 and an arcuate lower surface 397.

A sealing boot 398 is interposed between the upper end of the housing and the plunger 394.

Since the operating head shown in FIG. 29 is designed for being operated with small forces applied to the plunger 394, no separate biasing means is utilized and the biasing force on the plungers 130 and 132 in the switch are utilized for maintaining the elements in the normal neutral position, shown in FIG. 29. However, application of a radial force onto the upper end of the shaft 394 will tilt the head 395 and cause downward displacement of the actuator 389 to actuate the switch. Of course, it will be appreciated that the shaft 394 can be shifted around 360° of movement in any direction and will actuate the switch.

Thus, it will be appreciated that the novel snap-switch arrangement and the actuator heads can be used interchangeably, depending upon the environment or requirements.

While specific embodiments have been illustrated and described, numerous modifications come to mind without significantly departing from the spirit of the invention and the scope of protection is only limited by the scope of the accompanying claims.

We claim:

1. A limit switch comprising a switch housing and an actuator head connected to said switch housing, said switch housing having first and second pairs of spaced fixed contacts therein and first and second movable contacts supported on a carrier, first and second plungers reciprocated in said switch housing and cooperating with said carrier to respectively move said first and second movable contacts into respective engagement with said first and second pairs of fixed contacts, toggle spring means between said carrier and said plungers for producing a snap action of said movable contacts with respect to said fixed contacts, said actuator head having an actuator means reciprocated therein with cam means within said actuator head for reciprocating said actuator means to operate said plungers, said actuator means including first and second concentric reciprocable actuating elements with said cam means including first and second cams respectively cooperating with said actuating elements and in which said switch housing has first and second pivoted levers engaged by said actuating elements and engaging said plungers.

2. A limit switch as defined in claim 1, in which said carrier has first and second carrier elements pivoted about a common axis at one end and having said first and second movable contacts respectively at opposite ends.

3. A limit switch as defined in claim 2, in which said actuator head has a shaft rotated therein with said cam means secured to said shaft and configured to operate said first plunger when said shaft is rotated in one direction and to operate said second plunger when said shaft is rotated in an opposite direction.

4. An actuator head for a limit switch having first and second reciprocating plungers biased to a first position and having movable contacts associated therewith comprising a housing having a shaft rotatable therein with means for moving said shaft to a predetermined neutral position, first and second concentric actuator members respectively reciprocated in said housing, and first and second cam means on said shaft and respectively engaging said first and second actuator members, said cam means being configured so that rotation of said shaft in one direction will move said first actuator member to move said first plunger to a second position and rotation of said shaft in an opposite direction will move said second actuator member to move said second plunger to a second position.

5. A limit switch comprising a housing having a cavity therein with first and second pairs of spaced fixed contacts therein, first and second plungers reciprocable in said cavity, biasing means in said cavity biasing said plungers to a first position, carrier means including first and second pivotally interconnected elements and respectively having first and second movable contacts thereon, said first plunger cooperating with said first element and said second plunger cooperating with said second element to independently move said first and second elements and the respective movable contacts between the respective pairs of fixed contacts, toggle spring means interposed between said carrier means and said first and second plungers for maintaining said movable contacts in engagement with said first pair of fixed contacts when said plungers are in said first position and respectively moving said movable contacts into engagement with said second pair of fixed contacts when said plungers are moved from said first position.

6. A limit switch as defined in claim 5, in which said pivoted elements are pivoted about a common axis located between said first and second plungers.

7. A limit switch as defined in claim 5, further including lever means pivoted in said housing and aligned with said plungers and an operating head mounted on said housing for pivoting said lever means.

8. A limit switch as defined in claim 7, in which said operating head includes a reciprocating actuator means adapted to engage said lever means and operating means for reciprocating said actuator means.

9. A limit switch as defined in claim 8, in which said operating means includes a rotatable shaft having cam means for reciprocating said actuator means.

10. A limit switch as defined in claim 9, in which said actuator means includes first and second actuator elements and said cam means includes first and second cams respectively cooperating with said first and second actuator elements.

11. A limit switch as defined in claim 8, in which said operator means includes a reciprocating plunger.

12. A limit switch as defined in claim 11, in which said actuator means includes a reciprocating element and said reciprocating plunger has cam means engaging said reciprocating element.

13. A limit switch as defined in claim 12, in which said reciprocating plunger extends perpendicular to said reciprocating element.

14. A limit switch as defined in claim 8, in which said operating means includes a plunger having an operating cam at a lower end and supported for universal pivotal movement to move said actuator means.

15. A limit switch as defined in claim 14, in which said operating head has a swivel guide surface and said cam includes a head mounted in said swivel guide surface.

16. A limit switch as defined in claim 14, in which said operating head has a fixed plate with said plunger extending through and opening in said plate to accommodate universal pivotal movement of said plunger with respect to said plate.

17. A limit switch comprising a switch housing and an actuator head connected to said switch housing, said switch housing having first and second pairs of spaced fixed contacts therein and first and second movable contacts supported on a carrier, first and second plungers reciprocated in said switch housing and cooperating with said carrier to respectively move said first and second movable contacts into respective engagement with said first and second pairs of fixed contacts, toggle spring means between said carrier and said plungers for producing a snap action of said movable contacts with respect to said fixed contacts, said actuator head having an actuator means reciprocated therein with cam means within said actuator head for reciprocating said actuator means to operate said plungers, said cam means including a first cam and a pivoted lever interposed between said actuator means and said plungers for sequentially operating said plungers to thereby produce a two-stage operation of said switch.

18. A limit switch comprising a switch housing and an actuator head connected to said switch housing, said switch housing having first and second pairs of spaced fixed contacts therein and first and second movable contacts supported on a carrier, first and second plungers reciprocated in said switch housing and cooperating with said carrier to respectively move said first and second movable contacts into respective engagement with said first and second pairs of fixed contacts, toggle spring means between said carrier and said plungers for producing a snap action of said movable contacts with respect to said fixed contacts, said actuator head having an actuator means reciprocated therein with cam means within said actuator head for reciprocating said actuator means to operate said plungers, said carrier including first and second carrier elements pivoted about a common axis at one end and having said first and second movable contacts respectively at opposite ends, said actuator head having a shaft rotated therein with said cam means secured to said shaft and configured to operate said first plunger when said shaft is rotated in one direction and to operate said second plunger when said shaft is rotated in an opposite direction.

19. A limit switch having first and second reciprocating plungers biased to a first position and having movable contacts associated therewith and an actuator head comprising a housing having a shaft rotatable therein with means for moving said shaft to a predetermined neutral position, first and second concentric actuator members respectively reciprocated in said housing, and first and second cam means on said shaft and respectively engaging said first and second actuator means, said cam means being configured so that rotation of said shaft in one direction will move said first actuator member to move said first plunger to a second position and rotation of said shaft in an opposite direction will move said second actuator member to move said second plunger to a second position.

20. The limit switch of claim 19 including first and second pairs of fixed contacts and a carrier having first an second movable contacts with said plungers cooperating with said carrier to move said first and second movable contacts between respective pairs of fixed contacts.

21. The limit switch as defined in claim 20, in which said carrier includes first and second members pivoted about a fixed axis between said plungers.

22. The limit switch as defined in claim 20, further including first and second levers interposed between said first and second actuator members and said plungers, said levers being pivoted at one end on said housing.

* * * * *